US005549533A

United States Patent [19]

Olson et al.

[11] Patent Number: 5,549,533

[45] Date of Patent: Aug. 27, 1996

[54] COMBINED LEG PRESS/LEG EXTENSION MACHINE

[75] Inventors: Michael L. Olson; William T. Dalebout, both of Logan, Utah

[73] Assignee: Icon Health & Fitness, Inc., Logan, Utah

[21] Appl. No.: 140,584

[22] Filed: Oct. 21, 1993

[51] Int. Cl.[6] ..... A63B 23/04

[52] U.S. Cl. ..... 482/137; 482/100; 482/138

[58] Field of Search ..... 482/93–103, 133, 482/135–139

[56] References Cited

U.S. PATENT DOCUMENTS

| | | | |
|---|---|---|---|
| 4,227,689 | 10/1980 | Keiser . | |
| 4,317,566 | 3/1982 | Uyeda et al. . | |
| 4,358,108 | 11/1982 | Voris | 482/99 X |
| 4,369,966 | 1/1983 | Silberman et al. . | |
| 4,382,596 | 5/1983 | Silberman . | |
| 4,390,179 | 6/1983 | Szkalak . | |
| 4,505,475 | 3/1985 | Olschansky et al. . | |
| 4,509,746 | 4/1985 | Mask . | |
| 4,546,968 | 10/1985 | Silberman . | |
| 4,556,216 | 12/1985 | Pitkanen | 482/137 |
| 4,566,691 | 1/1986 | Mahnke . | |
| 4,627,614 | 12/1986 | de Angeli . | |
| 4,634,127 | 1/1987 | Rockwell . | |
| 4,662,631 | 5/1987 | Seal . | |
| 4,795,147 | 1/1989 | Seal . | |
| 4,809,972 | 3/1989 | Rasmussen et al. . | |
| 4,854,578 | 8/1989 | Fulks . | |
| 4,861,025 | 8/1989 | Rockwell . | |
| 4,900,018 | 2/1990 | Ish, III et al. . | |
| 4,930,768 | 6/1990 | Lapcevic . | |
| 4,986,538 | 1/1991 | Ish, III | 482/100 |
| 5,011,139 | 4/1991 | Towley, III | 482/100 X |
| 5,085,430 | 2/1992 | Habing . | |
| 5,120,289 | 6/1992 | Yu | 482/137 |
| 5,160,305 | 11/1992 | Lin . | |
| 5,195,937 | 3/1993 | Engel et al. . | |
| 5,230,680 | 7/1993 | Wu | 482/137 X |
| 5,290,214 | 3/1994 | Chen | 482/136 X |

FOREIGN PATENT DOCUMENTS

| | | | |
|---|---|---|---|
| 635999 | 12/1978 | U.S.S.R. | 482/100 |
| 2223686 | 4/1990 | United Kingdom | 482/100 |

OTHER PUBLICATIONS

Fitness Equipment Buyer's Guide, "Club Industry 1992 Year in Review", (advertisement for The Ultimate Combination), (2 pages supplied).

Advertisement for Marcy exercise system.

*Primary Examiner*—Richard J. Apley
*Assistant Examiner*—John Mulcahy
*Attorney, Agent, or Firm*—Trask, Britt & Rossa

[57] ABSTRACT

A multiple-exercise station may be used alone or as a station for a multi-gym type of exercise machine. The station has a frame supporting a bench for performance of leg presses and leg extensions. A user standing on the floor at one end of the bench may also perform standing leg curls. Two movable arms are attached to the frame at the one end of the bench. A first movable arm is pinned near the floor, having a plate attached to an upper end for placement of the feet of a user thereagainst. The first movable arm is rotated by the force of a user's legs, moving away at its upper end from the bench in response to a pressing action against the plate. A second movable arm is pinned at its top end to an aperture proximate the top of the first movable arm on the side opposite the bench. The lower end of the second movable arm is rotatable away from the first movable arm. A padded crossbar is attached to the bottom end of the second movable arm for engaging the back of the ankle of a user performing standing leg curls or for engaging the front of the ankle of a user performing sitting leg extensions. A cable attached to a resistance is reeved in a block and tackle arrangement around a first pulley mounted to the second movable arm and other pulleys mounted to the frame. When either the first or the second movable arm is rotated away from the frame, the appropriate resistance is provided by the cable acting on the first pulley to resist the motion.

19 Claims, 7 Drawing Sheets

COMBINED LEG PRESS/LEG EXTENSION MACHINE

BACKGROUND OF THE INVENTION

1. Field of the Invention

The invention pertains to the field of exercise machines and more particularly to exercise apparatus for leg presses, leg curls and leg extensions.

2. State of the Art

Exercise of the lower body has always been problematic, for strength conditioning in particular. The lower body has no hands. Therefore, unlike upper-body exercise, exercise of the legs does not have the benefit of prehensile digits and an opposed thumb for grasping a bar or handle to draw or drive a resistance or weight at will. Running, stepping, walking in all their forms limit the exercise participants to their own body weight.

Various exercise equipment may be employed while running or performing other exercises with legs. A user may add weight by means of barbells, or other lifting mechanisms. However, such devices often incidentally load the spine, shoulders, neck and torso as well as the legs. Such incidental loading can result in disproportionate conditioning and excessive strain or overwork for the upper body structure and muscles. Thus, when desiring to exercise a specific lower body muscle group, a user should ideally work out on an exercise machine which will isolate the motion and the loading of that specific muscle group.

Various exercise machines have a bench system for permitting a user to lie down on the back or stomach while working loaded levers or the like with the legs. Other machines permit a sitting or standing user to operate a padded harness attached to a weight or other resistance system. Some machines combine several movable elements with resistances in several configurations for performance of multiple exercises. Various stations may be arranged around a frame of an exercise machine for consolidating some functions of the machine offered by a variety of stations. Likewise, such machines are often most useful or economical if each station is adaptable for use in a number of exercises.

Several limitations arise however, in such state-of-the-art lower body exercise machines. Several different mechanisms are required to permit all the desired motions and loadings, loading being the force or resistance exerted by the machine on a user during the motions of an exercise. A user, particularly at home, often has insufficient financial resources to purchase the number or complexity of machines needed to achieve the desired range of exercises. Moreover, a home user often has limited space. Therefore, it is desirable to consolidate several types of exercise apparatus into a single machine, and such consolidation of features has often been attempted to reduce cost and size to manageable levels.

Numerous varieties of multiple-exercise apparatus for exercising the upper and the lower body have been marketed. In many, the resistance and distance of motion required by one muscle group are invariably different than those required by another muscle group. Therefore, any consolidation of the resistance mechanisms must result in a machine having an adjustment system for varying the mechanical advantage of the user against the resistance. Since the machines typically allow a series of exercises to be performed by engagement of various moveable members, they typically require reconfiguration. Adjustment of positions, engagement and disengagement of levers and resistances or weights and the like allow various members to serve multiple functions.

However, many such machines require substantial time for rearrangement to permit different exercises. A user must interrupt a series of repetitions of one exercise to configure or adjust the exercise machine for another series. Moreover, during an exercise session, a user will preferably "rotate" several times through a routine of several series of repetitions or "reps" of exercises. That is, a routine is established for exercising several muscle groups, one at a time, each with a series of repetitions. Then the entire routine is repeated. Thus, each muscle group is exercised for a time, then rested for a longer time while several other groups are exercised in turn. When several exercises of the series require some reconfiguration of an exercise machine, substantial time is wasted. A user would usually prefer to move smoothly from one exercise to the next in a routine without moving or dismounting from the exercise machine except possibly to change user position for properly executing a new exercise. Dismounting from the machine to reconfigure it can be extremely inconvenient.

The legs do not get a full range of motion by walking, running or many other exercises, but need specific motions and loads to properly develop all the muscles groups therein. Given the shape of the legs, and their ability to bend significantly in only one direction, most apparatus useful for leg lifts or extensions must be adjusted considerably to be converted to leg curls and further reconfigured for presses, if capable of such reconfiguration at all. Moreover, in each such exercise, the exercise apparatus must contact the leg at a very different location, move in a unique motion and, relative to the user, be in a unique position. In fact, since the feet are not prehensile, considerable attention must be devoted to machine designs for engaging the legs in exercises.

In summary, the combination of a multi-station exercise machine is seldom able to meet the many constraints of size, cost, simplicity, and universality. Nowhere are these constraints more evident than with machines for leg exercises. The various motions of the legs are substantially different once the leg is engaged to move against the resistance as well. Thus, what is needed is a machine which can accommodate leg extensions or lifts, leg curls and leg presses from a single station with minimal adjustment, preferably by a user from a single position with a minimal number of machine members. A system which does not require the hands nor require the user to leave a position at an exercising station is preferable. Compactness of all required apparatus in a single unit is highly desirable. Use in several different exercises of various moveable members, without disconnecting, reattaching, reconfiguring or repositioning those members is likewise highly desirable.

SUMMARY OF THE INVENTION

The present invention meets the foregoing needs in a single leg-exercising station for use in a multi-exercise apparatus. The system is adjustable by a user for the user's own size and strength before an exercise session. Thereafter, the system can be used without resorting to using the hands for adjustment. The user never has to leave the station during extensions, curls or presses for the legs.

The present invention comprises an exercise machine having a frame for supporting the machine on a support surface, and a bench associated with the frame for supporting a user. A first support is pivotally attached to the frame, extends upwardly therefrom and is moveable between a first press position at rest and a second press position away from the bench. A foot member is connected to the first support and positioned for contact by the feet of a user positioned on the bench.

An extension member, rotatably supported by the first support, extends downwardly toward the frame in a first extension position. The extension member is moveable to a second extension position away from the first support and the bench. A cross member is attached to the extension member for contact by a user to move the extension member in the performance of exercises.

A resistance system is interconnectable between the frame and the first support, to resist movement of the first support, ideally extending between the frame and the extension member to also resist movement of the extension member.

In one embodiment, the resistance system of the exercise machine includes a first guide connected to the extension member. A second guide mechanically associated with the frame is spaced away from the first support. A resistance mechanism includes a cable extending to interconnect the resistance mechanism, the first support member and the extension member. The cable is trained about the first guide and the second guide, then connected to the first support to resist movement of the first support by a user on the bench. The cable also resists movement of the extension member by a user.

In another variation of the same embodiment, the resistance mechanism includes a resistance guide associated with the frame, about which the cable is trained. The resistance mechanism also includes a tensioning mechanism for creating tension in the cable.

One embodiment of the exercise machine has a foot member that is movably attached to the first support member to move between a first position toward the bench and a second position away from the bench. The foot member may also be rotatably attached to the distal end of the first support member through an aperture by a removable pin. The foot member has a foot plate with an extension connected thereto. The extension has a plurality of apertures along its length. Each of the apertures is registrable with an aperture in the first support member.

DETAILED DESCRIPTION OF THE EMBODIMENTS OF THE INVENTION

Figure 1:
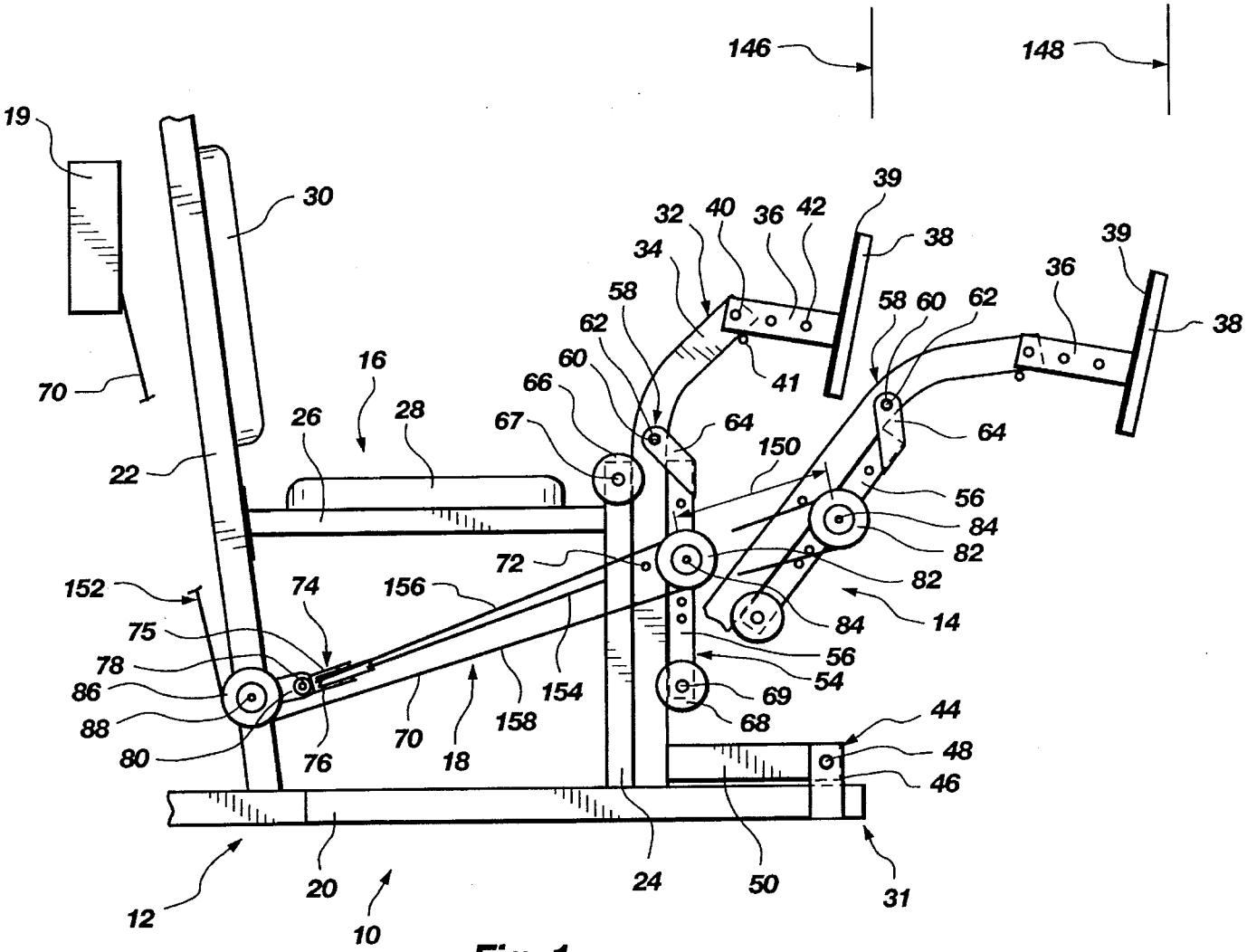
FIG. 1 is a side elevation view of the exercise machine of the invention showing the leg press apparatus in retracted and extended positions.
Figure 2:
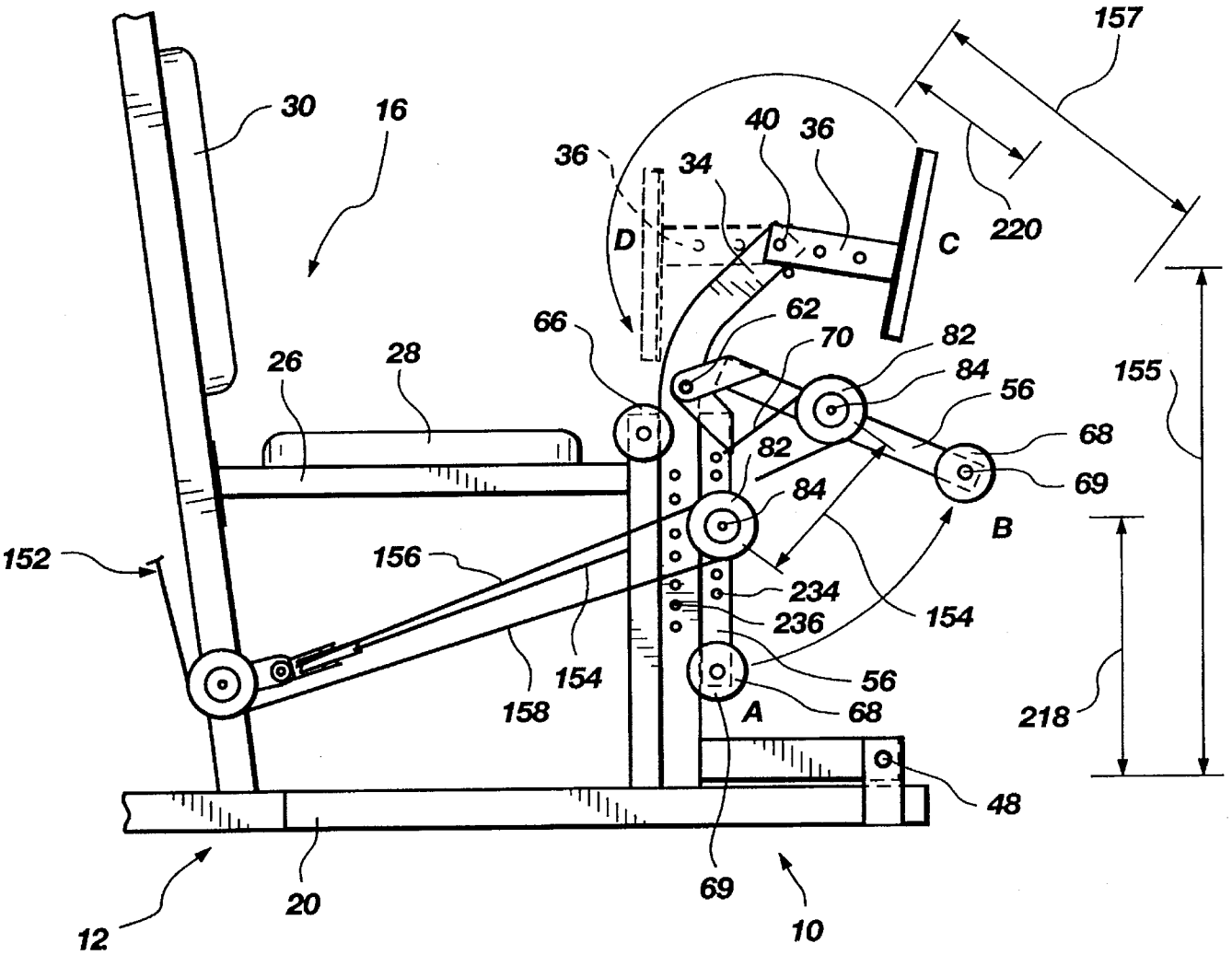
FIG. 2 is a side elevation view of the exercise machine of the invention showing the press plate in an operable position, and in phantom in the stowed position, with the leg curl assembly shown in retracted and extended positions.

The invention is best understood by reference to FIGS. 1–2 which show the exercise machine 10. The exercise machine 10 may actually be part of a larger apparatus having multiple stations for exercising different muscle groups of the body, or may be a self-contained unit as depicted. The exercise machine 10 comprises a frame 12, a leg exercising assembly 14 attached to the frame 12, a bench 16 supported by the frame 12 and a resistance assembly 18 movably secured to the frame 12 for connecting the leg exercising assembly 14 to a load system 19, generically designated as of a type to be hereinafter described. The load system may be one of a variety of types known in the art including weights, springs, elastic resistances and the like.

The frame 12 is comprised of the base 20 fixedly attached to a first upright 22 extending upwardly away from the base 20. A second upright 24 is also attached to the base 20 to extend vertically in the preferred embodiment. Between the first upright 22 and the second upright 24 is attached a transverse member 26. The first upright 22 and the transverse member 26 together support the bench 16. The seat member 28 of the bench 16 is attached to the transverse member 26 while the back member 30 of the bench 16 is attached to the first upright 22. The leg exercise assembly 14 is attached to the frame 12 and comprises a press assembly 32 attached to the base 20 of the frame 12 in the preferred embodiment. The press assembly includes a press arm 34 preferably having an arcuate upper end 35 and pivotally connected to the base 20.

A press bar 36 is adjustably connected to the press arm 34 for holding a press plate 38. The press plate 38 can be adjusted to be closer or further from the press arm 34 by removal and reinsertion of a press pin 40 in one of a series of longitudinally spaced press apertures 42 along the press bar 36. The press bar 36 rests on a support pin 41 above which the press bar 36 may rotatably move (clockwise in the illustrated embodiment), but below which the press bar 36 cannot drop. That is, in FIG. 2, the press bar 36 is shown to be rotatable counterclockwise about the press pin 40. The press pin 40 is also removable for the purpose of moving the press plate 38 toward the bench 16 during standing leg curl exercises by a user. The press arm 34 is pivotally connected at one end to the base 20 of the frame 12 by means of a press pivot 44. The press pivot 44 comprises a press ear 46 through which a first pivot pin 48 is inserted through a press beam 50. The press beam 50 is a lower member formed at right angles to the press arm 34. Thus the press beam 50 and press arm 34 in combination act as a single lever about the press pivot 44.

Therefore, the press assembly 34 effectively operates about press pivot 44 responsive to manipulation by the legs and feet of the user.

A curl assembly 54 is also attached to the press arm 34 for use in the performance of leg lifts and standing leg curls by a user. The curl assembly 54 comprises a curl bar 56 attached to a curl pivot 58 comprised of a curl aperture 60 holding a curl pin 62. The curl pin 62 secures the curl ears 64 on the curl bar 56 to the press arm 34. Two curl ears 64 straddle the curl bar 56 and are rigidly attached thereto. The same pair of curl ears 64 also straddles the press arm 34 forming a yoke-like structure to receive and rotate about curl pin 62.

Various padding systems for machine function and user comfort are used in various exercise machines known in the art. In the instant invention, a cylindrical fulcrum pad 66 is mounted to the second upright 24 near the seat 26 of the bench 16. For comfort, the legs of a user are draped over the fulcrum pad 66 when performing leg extensions. Likewise, when performing standing leg curl exercises, a user will rest the front of the thighs against the fulcrum pad 66 for maintaining leverage against the curl bar 56.

The fulcrum pad 66 is rotatably mounted on a rest bar 67 attached to the second upright 24, preferably at right angles thereto. A cylindrical instep or curl pad 68 mounted to a curl shaft 69 is rotatably attached securely to the curl bar 56. In the preferred embodiment, the press plate 38 will also include a thinner, preferably molded pad 39 having resilience and a gripping texture for comfortably and securely holding the feet of a user from slipping while performing leg press exercises.

A resistance cable 70 is connected to the frame 12 by an anchor 72 attached to the second upright 24. The anchor 72 fixes the cable 70 from translating with respect to the frame 12 while permitting flexibility, rotation or both, as needed. The cable 70 runs from the anchor 72 to a guide 74 comprised of a guide pulley 75 around which the cable 70 is trained. The guide pulley 75 is held in a yoke 76 to rotate therein. Meanwhile, the yoke 76 is connected by means of a swivel 78 to a mount 80 fixed to the first upright 22 of the frame 12. Thus, the guide pulley 75 is free to rotate and to swivel to maintain alignment with other moveable parts of the exercise apparatus.

The cable 70 is trained around the guide pulley 75 to movably pass around the rotating guide pulley 75 to a first pulley 82 mounted on a first axle 84 mounted to the curl bar 56. The cable 70 then passes around a second pulley 86 rotatably attached to a second axle 88 attached to the first upright 22 of the frame 12.

Figures 3, 4, 5, 6:
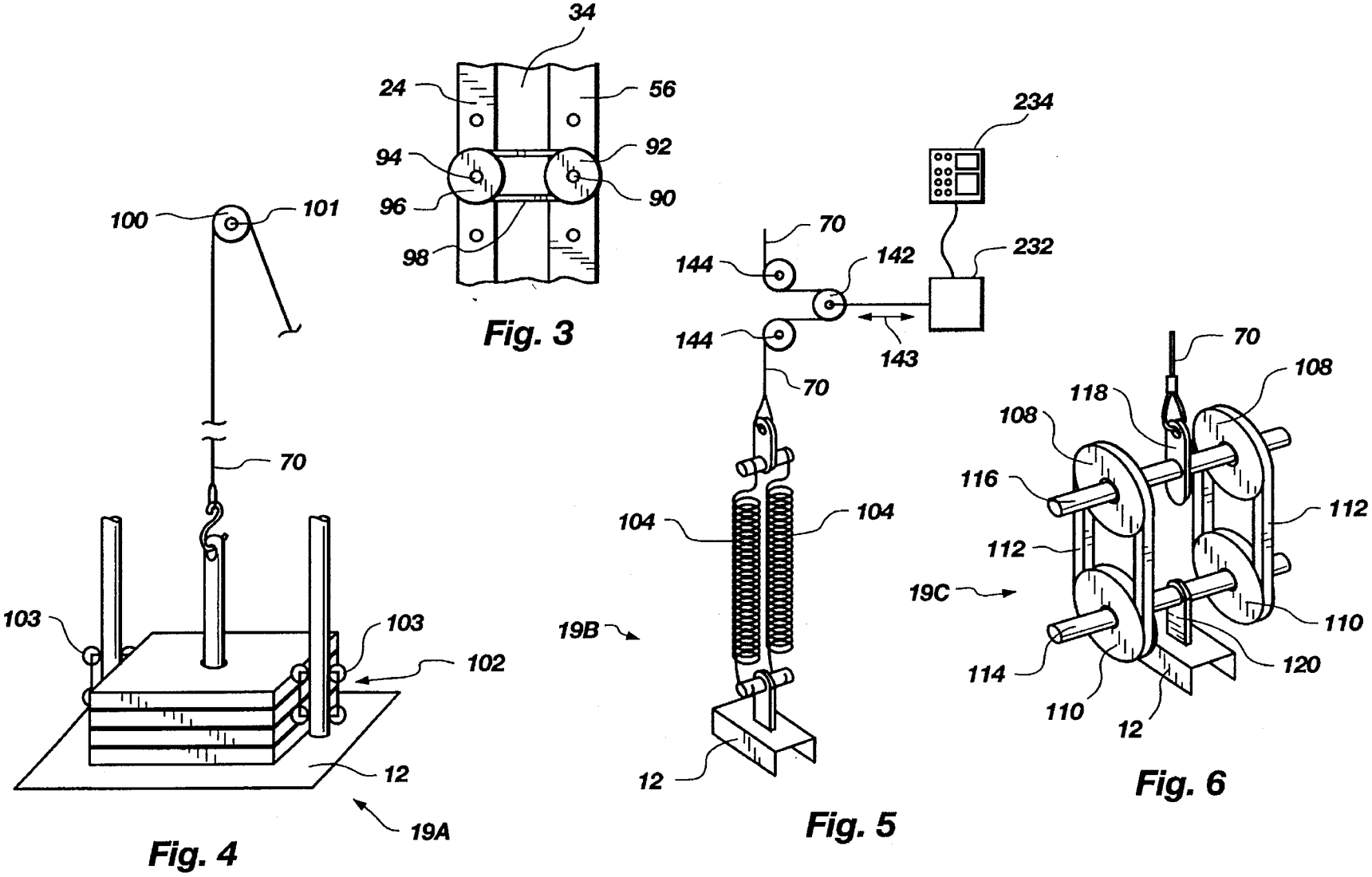
FIG. 3 is a detailed elevation view of the moveable arms of the invention showing an elastic resistance connected by spools to the pins of the exercise machine.
FIG. 4 is an isometric view of a weight stack for providing resistance to the cable of the invention.
FIG. 5 is an isometric view of a spring system for loading the cable of the resistance system.
FIG. 6 is an isometric view of an alternate resistance system using elastic members in place of a weight stack.

Referring to the resistance systems of FIGS. 3–6, the exercise apparatus may use a variety of load systems 19 for applying force to the cable 70. In one embodiment, the cable 70 is not actually required. In the apparatus of FIG. 3, a first pin 90 is fixed to extend away from the curl bar 56 for holding a first spool 92. A second pin 94 is fixedly secured to extend at right angles from the second upright 24 of the frame 12 for holding a second spool 96. An elastic member 98 is looped around the first spool 92 and the second spool 96 for providing a selected level of resistance whenever the curl bar 56 is moved away from the second upright 24 of the frame 12 during the performance of exercises by a user. A plurality of possible first pins 90 and second pins 94 may be attached as shown for variations in mechanical advantage. Alternatively, the pins 90 and 94 may themselves be movable to various positions, or be mounted to sleeves slidable upwardly and downwardly on upright 24 and curl bar 56. Of course, a variety of elastic members 98 of various resiliencies may also be employed to increase resistance as the user builds strength.

In the preferred embodiment illustrated in FIG. 4, the cable 70 passes over a third pulley 100 mounted to rotate on a third axle 101 fixed to the frame 12 at a convenient point above the second pulley 86. The cable 70 is trained around the third pulley 100 rotating around the third axle 101, and is connected to the generic load system 19. FIGS. 4–7 show various embodiments of the generic load system 19 configured as a weight system 19A, spring system 19B, elastic system 19C and adjustable lever system 19D. In the various embodiments shown in FIGS. 4–7, any of the proposed load systems 19 (19A–19D) can be attached to the cable 70 as shown.

In FIG. 4, the weight stack 102 provides the resistance to movement of the cable 70. The weight stack 102 is moveable with respect to the frame 12 but is preferably stabilized to run along a guide 99 by means of trolleys 103.

In FIG. 5, one or more springs 104 provide the resistance to motion, each spring being anchored to the frame 12 at one end and to the cable 70 at another end.

The elastic load system 19C of FIG. 6 is similar to the spools 92, 96 of the embodiment of FIG. 3 with their elastic band 98 wrapped therearound. The upper spools 108 are connected to the lower spools 110 by the elastic bands 112. The elastic bands are closed loops which can be stretched between the upper spools 108 and the lower spools 110. The lower spools 110 are removably positioned on a fixed bar 114 anchored to the frame 12 of the exercise machine 10. By contrast, the upper spools 108 are removably positioned on the moveable bar 116 attached to the cable 70 by means of the draw tab 118. In a similar fashion, an anchor tab 120 fixes the fixed finger 114 to the frame 12.

Figure 7:
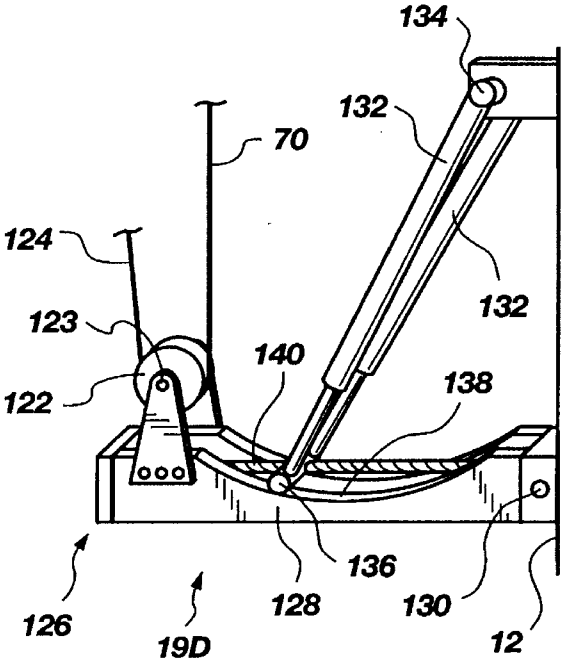
FIG. 7 is an isometric view of an alternate embodiment of the resistance mechanism for providing resistance to the cable.

In the apparatus of FIG. 7, the cable 70 is preferably trained around a fourth pulley 122 although the cable end 124 could also be fixed to the distal end 126 of the lever arm 128. In the preferred embodiment of the configuration of FIG. 7, the cable 70 is trained around the fourth pulley 122 rotatably attached by a fourth axle 123 to the lever arm 128.

The details of the embodiment of FIG. 7 can be found in U.S. patent application Ser. No. 07,835,783, now issued as U.S. Pat. No. 5,316,534, assigned to the assignee of the present invention and hereby incorporated herein by reference. A pair of gas cylinders or gas springs 132 are pivotally mounted at the pivot pin 134 to the frame 12 to provide resistance, their leverage advantage being adjusted by motion of a moveable connector 136 riding along a curved surface or curved member 138 attached to or manufactured as part of the lever arm 128. A screw 140 turns to move the moveable connector 136 along the curved member 138.

Figure 11:
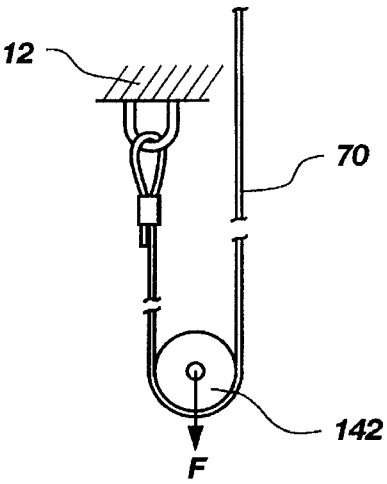
FIG. 11 is a side elevation view of the cable fixed to the frame and tensioned by an idler pulley.

Adjustment of the load system 19 for the exercise machine 10 can be made as appropriate to the embodiment by adding or subtracting weights from the weight stack 102 or by pre-extending or biasing the springs 104 to change the load. An idler pulley 142 may be moved along the direction 143 to draw part of the cable 70, effectively lengthening or shortening the cable 70 and extending the springs 104. The anchor pulleys 144 are mounted to the frame 12 to effectuate operation of the idler pulley 142. The idler pulley 142 is selectively moveable for adjustment. Moreover, the idler pulley can be used in any configuration using the cable 70 as a tensioner for maintaining tension in the cable 70. A variation of a loading system 19 could even be attached to the idler pulley 142 while the end of the cable 70 is also attached to a loading system 19. Likewise, the idler pulley 142 could be attached to any load system 19 directly, for applying a force F maintaining resistance and tension, while the cable is fixed to the frame 12 as in FIG. 11, with or without the anchor pulleys 144 of FIG. 5.

The resistance force felt by a user in moving the cable 70 in the performance of exercises, can be adjusted in the apparatus of FIG. 6 by sliding the upper spool 108 and lower spool 110 from the movable bar 116 and fixed bar 114 respectively. A more resistant elastic band 112 or additional elastic bands on upper and lower spools 108, 110 can be attached to the movable bar 116 and fixed bar 114 respectively. The elastic bands 112 with their upper and lower spools 108, 110 are disclosed in detail in U.S. Pat. No. 5,135,216, assigned to the assignee of the present invention and incorporated herein by reference.

An alternate embodiment of the cable arrangement of the invention is illustrated in FIG, 8. The cable 70 can be anchored to the frame 12 near the guide pulley 75 and reeved around a press pulley 77 mounted to rotate on the press arm 34. Thus, approximately twice as much length of the cable 70 must be extended when a user moves the press arm 34 as when a user moves the curl bar 56. That is, both the first pulley 82 and the press pulley 77 draw cable when a user moves the press arm 34. By contrast, only the first pulley 82 draws cable when a user moves the curl arm 56. One or more additional pulleys 97 may provide guidance and reduced friction for the cable 70 as it continues from the second pulley 86 to the load system 19, illustrated as the embodiment employing the weight stack 102 in FIG. 8.

Figure 9:
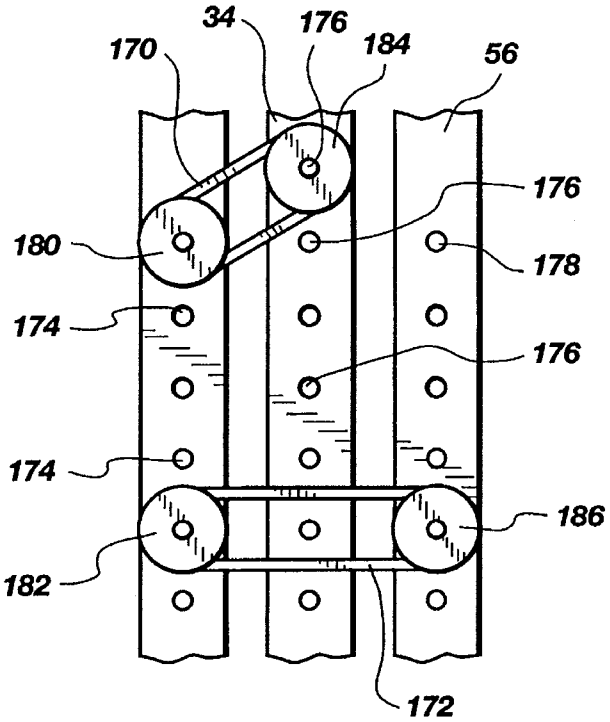
FIG. 9 is a side elevation view showing a segment of the frame and the two moveable members with an elastic strap and spool resistance system attached to provide differential loading depending on which moveable member is acted upon by a user.

A similar principle can be applied to the elastic resistance straps 170, 172 as shown in FIG. 9. The elastic straps 170, 172 provide resistance to movement between the frame pins 174 and press pins 176 and between the frame pins 174 and curl pins 178, respectively. The spools 180, 182 are set over the frame pins 174, while the spools 184, 186 are set over the press pins 176 and the curl pins 178, respectively. Thus, the load or force giving rise to the resistance to movement of the press arm 34 by a user is greater than the load arising from movement of the curl bar 56.

Figure 8:
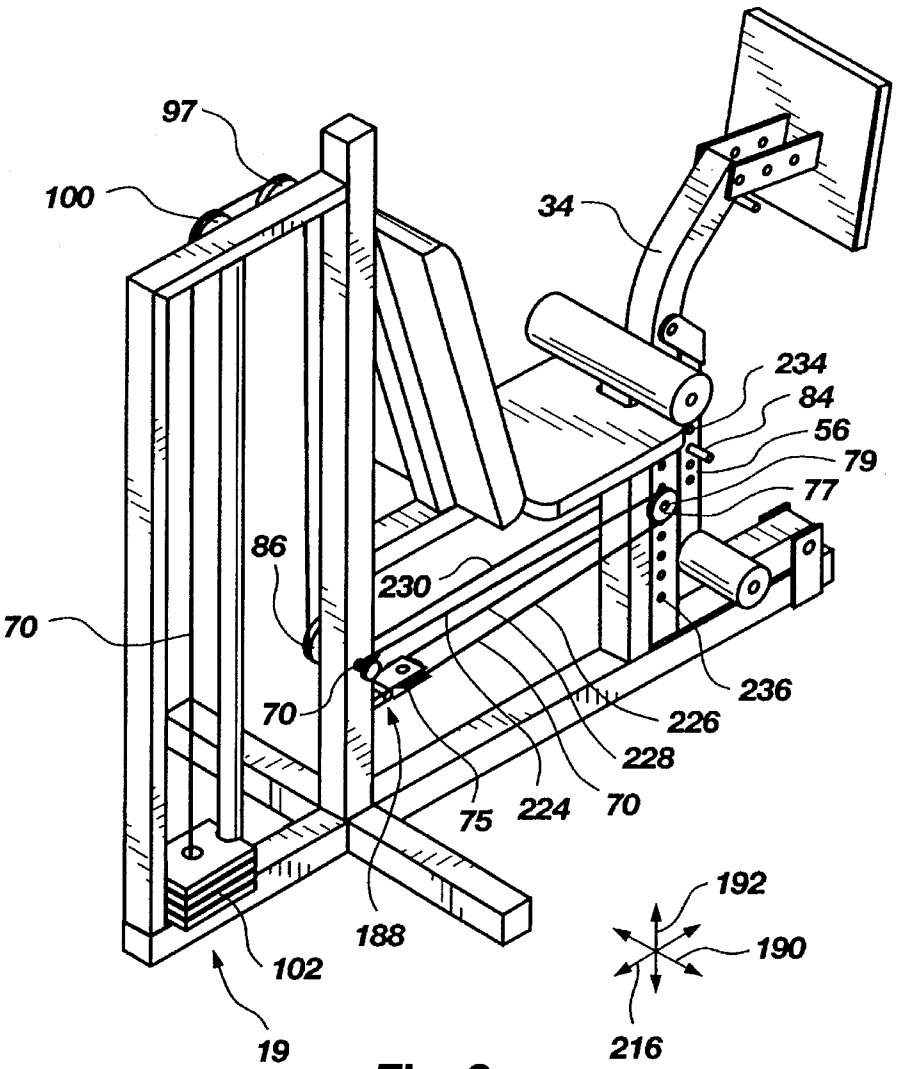
FIG. 8 is an isometric view of the exercise machine of the invention showing an alternate cable attachment scheme in which the cable is reeved around a pulley on each of the moveable members.
Figure 10:
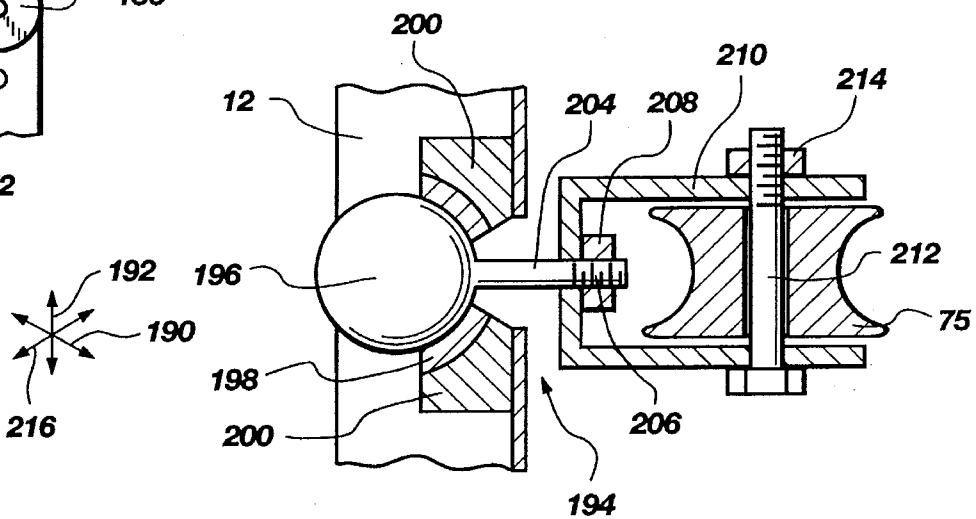
FIG. 10 is a side elevation view in cutaway of an alternate mounting system for the guide pulley.

The guide pulley 75 of FIGS. 1 and 2 can have a universal 188 with first and second axes of rotation 190, 192 as shown in FIG. 8. In the alternative, the swivel 194 of FIG. 10 or its equivalent could be used. The benefits of the swivel 194 include perfect alignment of the guide pulley 75 for all configurations and orientations of the cable 70. This alignment can be particularly important as the first pulley 82 moves up and down along its arcuate paths in response to movement of the press arm 34 and the curl bar 56.

A ball 196 fits in a socket liner 198 preferably of a material having a low coefficient of friction with respect to the ball 196. The socket liner 198 fits in a mounting block 200 attached to the frame 12 and having a socket 202 therein. A shaft 204 fixed to the ball 196 extends to a threaded end 206 on which a nut 208 secures the yoke 210. The yoke 210 rotatably supports the guide pulley 75 on a bolt 212 secured by a nut 214. One advantage of the swivel 194 is that three degrees of freedom (rotation about first second and third axes of rotation 190, 192 and 216) are available to provide for perfect alignment of the guide pulley 75.

OPERATION

In operation, the exercise machine can be used for at least three types of exercises: leg presses, leg extensions, and leg curls. Variations in the leverage advantage of the exercise machine 10 providing resistance to the movement of a user is automatically afforded without adjustments or reconfiguration. Different exercises require no adjustment other than that of the level of resistance. The user may however, need to adjust the machines for his or her size.

For performing leg press exercises, a user positions the press plate 38 as shown in FIG. 1. The press pin 40 may be removed and inserted in any desired press aperture 42 in order to control the distance between the back member 30 and the press plate 38, thus matching a user's leg length properly. The user's legs straddle the press arm 34 to position the feet of a user on either side of the press bar 36 against the foot pad 39 mounted on the surface of the press plate 38.

The user is seated on the seat member 28 with the knees drawn toward the chest and the press plate 38 in the retracted position 146. The press arm 34 is positioned against the frame 12. The user then extends the legs pushing the press plate away from the back member 30 of the bench 16 to an extended position 148.

Meanwhile, the cable 70 is drawn by the first pulley 82. From the load system 19 is drawn a length of the cable 70 equal to about three times the linear distance 150 travelled by the press arm 34. That is, three times the distance 150 in length of cable 70 must pass the position 152. In segment 154, a length equal to distance 150 must be provided around the guide pulley 75 to accommodate the motion of the press arm 34. Meanwhile, in the segment 156, an equal length of cable 70 must also be provided to permit the first pulley 82 to move the required distance 150. However, the segment 156 is also providing cable length to the segment 154, requiring that a length equal to twice the distance 150 must pass around the first pulley 82. Meanwhile, the segment 158 must provide enough length of the cable 70 to permit the first pulley 82 to move the distance 150, for a sum of cable length of substantially three times the distance 150. That total length of cable 70 passes around the second pulley 86 to the system 19. Thus, a three to one leverage advantage favors the load system 19 resisting the motion of the cable 70 for leg press exercises.

In the performance of leg extensions, a user sits on the seat 28 of the bench 16 with the knees bent over the fulcrum pad 66, the lower legs extending downwardly, the curl or instep pad 68 fitted just above the instep on the leg of the user. The exercise is performed by straightening the lower leg to extend straight out from the upper leg resting across the fulcrum pad 66.

The curl bar 56, during this exercise, moves from Position A in FIG. 2 to Position B. As the curl pad 66 is moved along with the curl bar 56 into the Position B, the first pulley is moved a distance 154. However, in this exercise, the segment 154 has not moved. Only the segments 156 and 158 move. Thus, the load system 19 moves effectively about twice the distance 154.

Of course, the effective length 155 of the press arm 34, and the entire press assembly 32, actually, is configured to provide the proper mechanical advantage of a user's legs against the load system 19 of the resistance assembly 18. Likewise, the effective length 157 of the curl assembly 54 is designed to provide the proper mechanical advantage of the user's legs in an extension exercise against the load system 19 resisting motion of the cable 70. However, an important feature exists in the multiple configurations which the resistance assembly system can take by virtue of engagement of the different segments 154, 156, 158 of the cable 70. Thus, the combination of lever arm provided by the effective lengths 155, 157 and the differing lengths of the cable 70 which must move around the second pulley 86 provide great versatility with no need for adjustment between exercises.

In the leg curl configuration, the user flips the press bar 36 from the Position C shown in FIG. 2 to the Position D shown in phantom in FIG. 2. The user now stands facing the bench 16 with the curl pad 68 behind and below the calf. The user can rest the arms on the press plate 38 or may grasp the press plate 38 with the hands for stability.

The performance of a leg curl exercise involves the user raising one lower leg at a time. A user stands facing the bench, with both legs positioned to have the curl pad 68 behind the ankles. The knees are prevented from moving forward by bracing the knees, or the thighs just above the knees, against the fulcrum pad 60. The user bends the leg to be exercised at the knee, moving the curl pad 68 rearward with the corresponding ankle. The curl pad 68 arcs upwardly away from the press arm 34. The thigh remains more or less vertically oriented, braced by the fulcrum pad 60. The curl pad 68 is thus lifted between the Position A and the Position B in FIG. 2, approximately. Meanwhile, the curl bar 56 rotates about the curl pin 62. The cable 70 responds in a manner similar to that for leg extension exercises in which the curl pad 68 is lifted between Positions A and B.

Thus, in the exercise machine of the invention, a user can do a leg curl, leg extension or a leg press exercise without having to dismount from the exercise machine 10 to make any adjustment of the exercise apparatus. The curl assembly 54 or the press assembly 32 can be engaged simply by the user positioning the legs to engage either the curl pad 68 or the press plate 38, respectively.

The muscle groups exercised in the performance of leg presses are powerful and require large values of resistance. The muscle groups exercised by leg curls require much less resistance. In either event, the disclosed arrangements of the cable 70 of the invention provide a larger resistance (at the first axle 84 or press pulley axle 79, or both) to motion of the press arm 34 than to the curl bar 56.

One adjustment of the resistance is approximately in proportion to the number of cable segments 154, 156 and 158 (FIGS. 1–2) and 224, 226, 228, 230 (FIG. 8) acting against either the press arm 34 or the curl bar 56 during an exercise. This number relies on the number of pulleys engaging the cable 70 in a block and tackle effect.

The cable ratio is the number of cable segments 154, 156 158, 224, 226, 228, 230 acting during an exercise. For presses, that number is always greater than the number for curls. The illustrated press to curl cables ratios are approximately 3:2 (FIGS. 1–2) and approximately 4:2 (FIG. 8). The cable ratio cannot be changed except by fixing the cable at an appropriate point or by adding pulleys such as the press pulley 77. Nevertheless, due to the arrangement of the invention, the press to curl cable ratio results in an instantly selective mechanical advantage according to the exercise, without adjustment.

Moreover, the mechanical advantage of the press plate 38 over the cable 70 is controlled by the press lever ratio. The press lever ratio is the ratio of the effective length 155 (measured between the press pin 40 and the first pivot pin 48) to the press lever length 218 (measured between the press pin 40 and the first axle 84). That is, the mechanical advantage of the legs (acting on the press plate 38) against the cable 70 (at the first axle 84 and anchor 72 in FIGS. 1–2 or at the first axle 84 and press pulley axle 79 in FIG. 8) in the performance of leg presses is controlled by the press lever ratio.

Likewise the corresponding mechanical advantage (leverage) of the legs (acting on the curl shaft 69) against the cable 70 (at the first axle 84) in performance of leg curls is controlled by the curl lever ratio. The curl lever ratio is the ratio of the effective length 157 (measured between the curl pin 62 and the curl shaft 69) to the curl lever length 220 (measured between the curl pin 62 and the first axle 84).

The overall balance of the curl lever ratio to the press lever ratio is approximately 0.6 in the preferred embodiment. This ratio is designed to exercise the appropriate muscle groups to the appropriate degree using the same load system 19 attached to the cable 70 adjusted to apply the same tension in the cable 70. In the illustrated embodiment of FIGS. 1–2 the resulting force balance between a press exercise and a curl exercise is approximately 0.6 (from lever ratios) times ⅔ (from cable ratios) for a curl force approximately 0.4 times the press force. In the embodiment of FIG. 8, the force balance between a press exercise and a curl exercise is approximately 0.6 (from lever ratios same as in FIG. 1) times ¾ (from cable ratios) for a curl force of approximately 0.3 times the press force.

By permitting the first axle 84 to be selectively positionable among the apertures 234 in the curl bar 56, the balance of the cable ratio and the press lever ratio to curl lever ratio can be cutomized. Likewise the anchor 72 (FIG. 1) or press pulley axle 77 (FIG. 8) can be made adjustable by positioning in one of the apertures 236 along the press arm 34. Thus the relative resistance experienced by a user during leg curls and leg presses can be adjusted precisely for that user's specific condition.

In the invention, elements in any generic combination of apertures and pins may be interchangeable as to the member to which each element pertains. However, unused apertures do not create interference with the motion of a user, and are less expensive to produce.

Meanwhile, the load system 19 as shown in FIGS. 4–7 can be adjusted to bias the overall tensioning force applied to the cable 70 for any exercise session. Automatic variation of the load system 19 is an alternative which biases the resistance felt by a user in performing both leg curls and presses in equal proportions. Such adjustment may be made by a servo control accessed remotely from an electronic console available to a user. For example, a servo 232 controlled remotely from a console 234 accessible to a user performing exercises may move the idler pulley 142 in the direction 143 (FIG. 5).

Such motion of the idler pulley 142 will bias any resistance following Hooke's law of elasticity or Boyle's law for gases. These laws apply to load systems 19 based on such items as steel springs 104, elastic bands 112, gas springs 132 or the like.

Manual adjustment is also available, as is non-adjustability. For non-adjustable resistances, no appreciable pre-loading or biasing is possible safely. Thus, each exercise typically begins with approximately zero resistance. With adjustability, each exercise begins with some bias above which the exercise machine 10 operates and below which the resistance does not descend.

Figure 13:
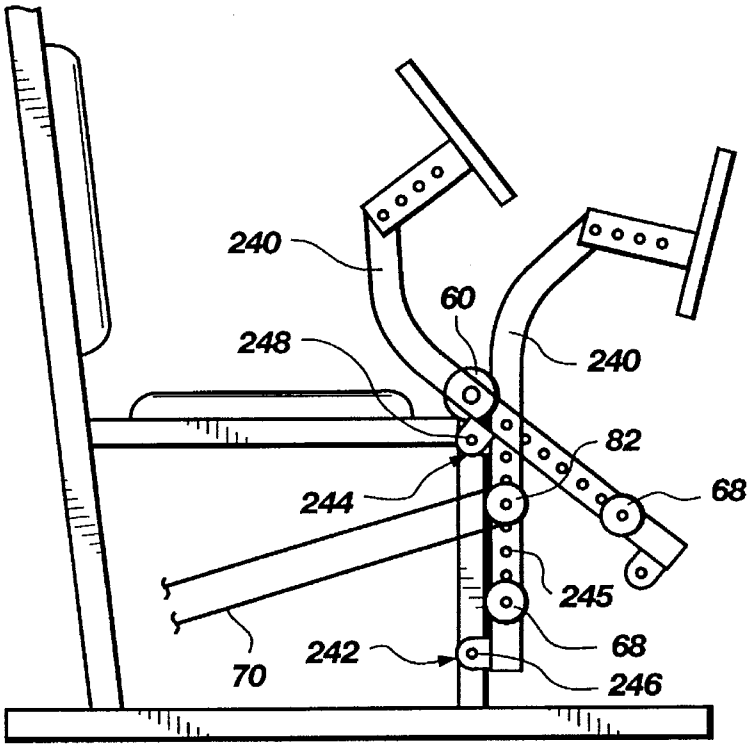
FIGS. 12–13 are side elevation views of an alternate embodiment of a moveable member of the invention.
Figure 12:
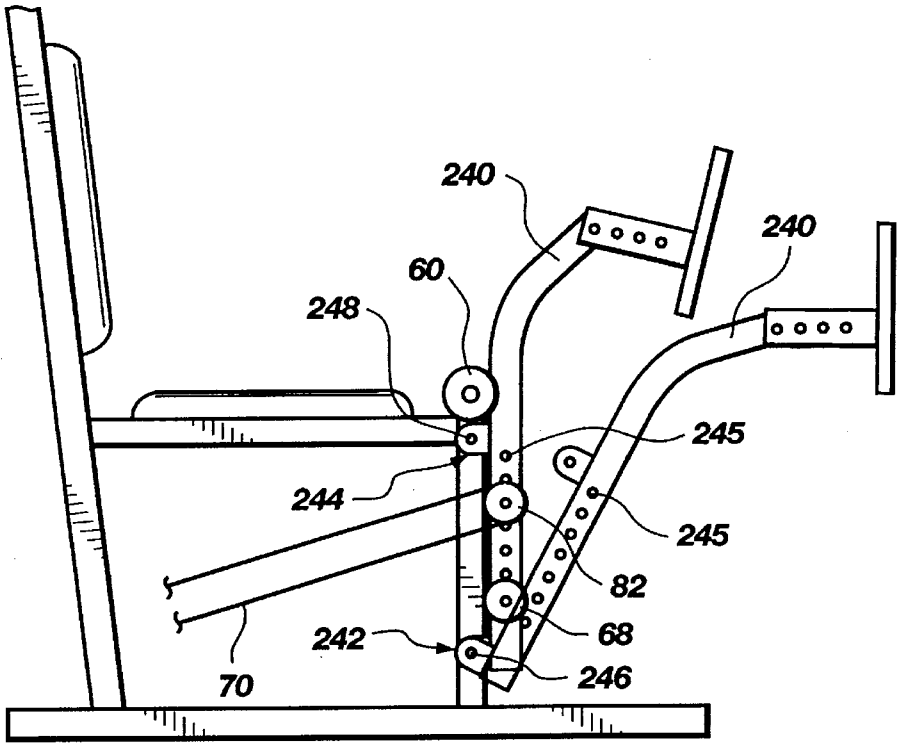

The alternative embodiment of FIGS. 12–13 permits a single moveable member 240 to be attached selectively to the frame 12 at a first pivot 242 and a second pivot 244 by a first and second pivot pin 246, 248, respectively. The curl pad is connected to the moveable member 240 near the first pivot, while the fulcrum pad is attached to the frame 12 near the second pivot 244. The fulcrum pad 60 may be attached to the moveable member 224 if positioned in close proximity to the second pivot 244 to prevent too great motion of the fulcrum pad 60 during leg lift exercises. In the preferred embodiment, the first pulley 82 on the first axle 84 is positionable in apertures 245 along the moveable member 240. This adjustment is important for the reasons discussed above relative to balancing the lever ratios for mechanical advantage experienced by different muscle groups. The closer to the second pivot 244 that the first pulley 82 is placed, the less force is required for leg lifts and leg curls. Likewise, the closer to the first pivot that the first pulley is placed, the less force is required for leg presses.

Thus, the effective forces corresponding to various exercises can be adjusted relative to each other. Then the cable 70 can be loaded or tensioned by a loading system 19, or pre-loaded or biased if desired, all as described above. The block and tackle combinations described above also apply to the moveable member 240 in the configuration of FIGS. 12–13.

Figure 14:
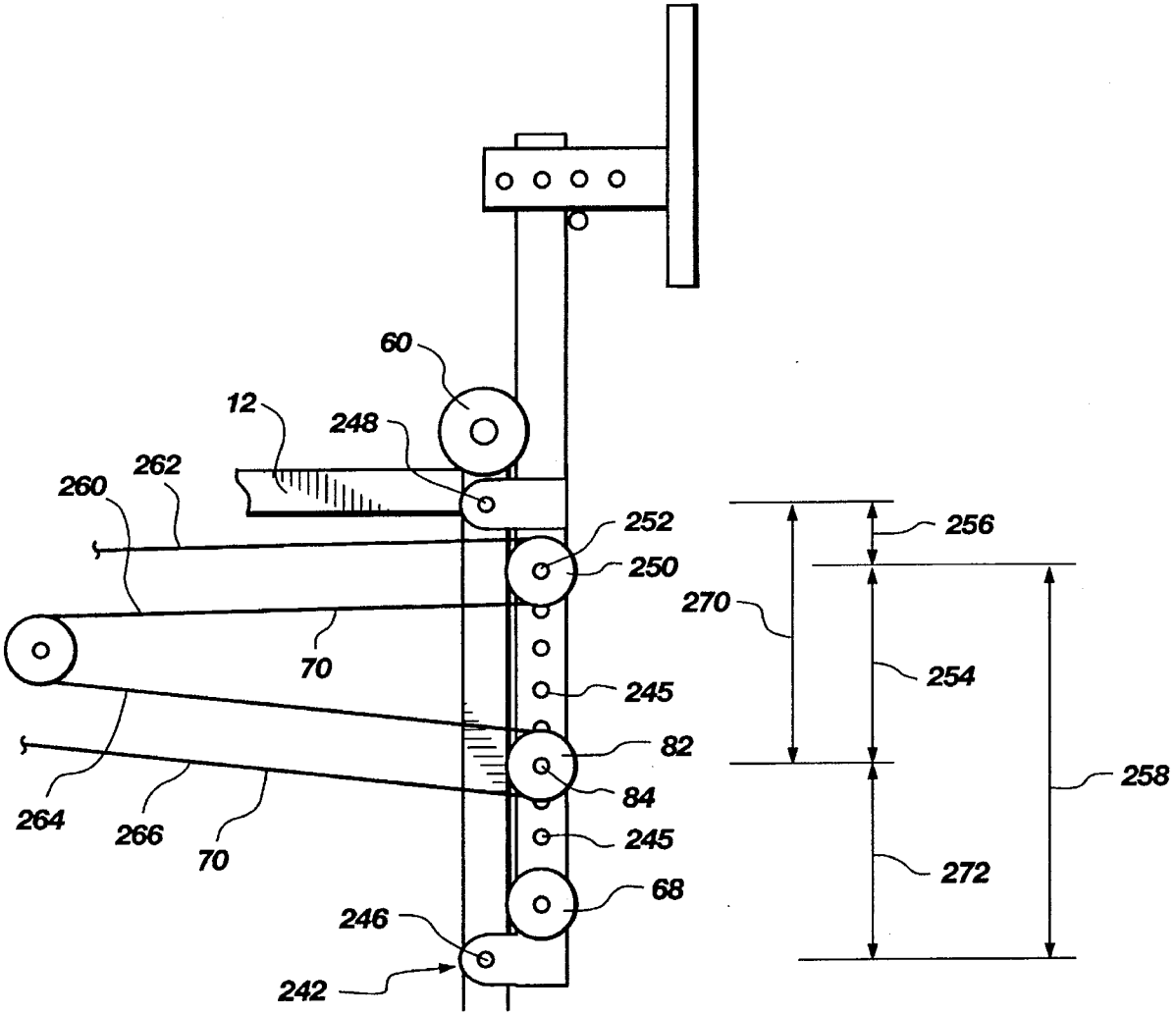
FIG. 14 is a side elevation view of a cutaway section of the exercise machine of FIGS. 12–13 showing a straight moveable member and multiple pulleys.

In FIG. 14, an alternate embodiment includes an offset pulley 250 on an offset axle 252 located at a position along the moveable member 240 for changing the mechanical advantage described above relative to cable ratios. The offset axle 252 is offset (spaced apart) a distance 254 from the first axle 84 to be nearly coincident with the second pivot pin 248. Thus, when the moveable member 240 pivots around the second pivot pin 248, almost no force contribution results at the offset axle 252 because it is only misaligned by the small misalignment distance 256 from the pivot pin 248. Therefore, virtually no leverage results at the offset axle 252 during leg curl exercises.

By contrast, when the second pivot pin 248 is removed, releasing the corresponding end of the moveable member 240, the cable 70 acts at a press lever distance 258. Thus, as in the embodiment of FIG. 8, the force resisting a user performing a leg press is substantially more than that when performing a leg curl. Likewise, as discussed above, the effects of multiple cable segments 260, 262, 264 and 266 alter the resistance forces depending on the engagement configuration of the pivot pins 246 and 248. Meanwhile the positioning of the first axle 84 also permits alteration of the leverage on the moveable member 240. The curl or leg curl exercises are performed against effectively two of the cable segments 264, 266 with an effective lever or curl lever distance 270. The press or leg press exercises are performed against two cable segments 260, 262 with an effective lever equal to the press lever distance 258 and against two cable segments 264, 266 with an effective lever equal to the distance 272.

Of course, it is understood, that the process of pivoting may be done about an axis rather than any axle type of member described herein, by suitable design of a suspension system. Nevertheless, an axle and bushing type of attachment to serve as a pivot has been found to be a cost-effective and durable alternative.

The embodiments disclosed herein are illustrative only. Other obvious variations of the invention will be readily apparent to those skilled in the art. Wherefore, the invention is limited only by its claims.

What is claimed is:

1. An exercise machine comprising:

a frame for positioning on a support surface;

bench means associated with said frame for supporting a user thereon;

a first support member pivotally attached to said frame and extending upwardly therefrom, said first support member having a first end and being moveable between a first press position wherein the first end of said first support member is proximate said bench means and a second press position wherein the first end of said first support member is displaced away from said first press position and said bench means;

a foot member connected to said first support member and positioned for contact by the feet of the user positioned on said bench means;

an extension member rotatably supported at its first end by said first support member, said extension member having a second end extending downwardly from said first end, said extension member being moveable between a first extension position proximate said first support member and a second extension position wherein the first end of said extension member is spaced from said first extension position;

a cross member attached to said extension member for contact by a user to move said extension member in the performance of exercises; and resistance means operationally engaging said frame and said extension member for resisting movement of said first support member and said extension member.

2. The exercise machine of claim 1, wherein said resistance means includes:

a first guide connected to said extension member;

a second guide mechanically associated with said frame and spaced away from said first support member;

a resistance mechanism having cable means extending therefrom for transmitting resistance provided by said resistance mechanism to said first support member and extension member, said cable means being trained about said first guide and said second guide for resisting movement of said first support member upon movement thereof by a user on said bench means and for resisting movement of said extension member upon movement thereof by a user.

3. The exercise machine of claim 2, wherein said resistance mechanism includes a resistance guide associated with said frame about which said cable means is trained and a tensioning mechanism to tension said cable means.

4. The exercise machine of claim 2, wherein said foot member is movably attached to said first support member to move between a first position toward said bench means and a second position away from said bench means.

5. The exercise machine of claim 4, wherein said foot member is rotatably attached to the first end of said first support member through an aperture by a removable pin and wherein said foot member has a foot plate with an extension connected thereto, said extension having a plurality of apertures along its length whereby a distance between said foot plate and said first support member is adjusted by the selection of a specific extension aperture.

6. An exercising machine comprising:

a frame for supporting an exercise machine on a surface;

a bench secured to the frame for supporting a user;

a first arm rotatably attached at one end to the frame for movement at another end by a user between a first position and a second position;

a second arm rotatably connected at a first end to the first arm proximate the other end thereof, a second end of the second arm being movable by a user between a retracted position proximate the first arm and an extended position away from the first arm;

a foot member movably attached to the other end of the first arm and positionable between a first position toward the bench means associated with said second arm for contact by a user on said bench for urging said second arm from said retracted position to said extended position; and a second position away from the bench; and a resistance member operationally engaging the frame and the second arm to resist movement of the first arm and to resist movement of the second arm.

7. The exercise machine of claim 6, wherein the resistance member includes:

a first guide connected to the second arm;

a second guide connected to the frame and spaced away from the first guide;

a cable trained around the first and second guides; and a resistance mechanism operable to resist motion of the cable.

8. The exercise machine of claim 7 further including a third guide to control the direction of a resistance force applied by the cable to the second arm through the first guide, said third guide being attached to the frame with said cable being movably trained around said third guide.

9. The exercise machine of claim 7 wherein the first guide is a first pulley and the second guide is a second pulley.

10. The exercise machine of claim 9 wherein the second pulley is connected to swivel from the frame and to be positionable by the cable.

11. The exercise machine of claim 7, wherein the resistance mechanism includes a resistance guide associated with the frame for guiding the cable trained therearound and a tensioning mechanism to tension the cable.

12. The exercise machine of claim 7 wherein said foot member is positionable between a first position toward the bench and a second position away from the bench.

13. The exercise machine of claim 6, wherein the foot member includes a foot plate connected to an extension having a plurality of apertures therealong whereby a distance between said foot plate and said first arm is adjusted by a removable pin through a preselected aperture of the plurality of apertures.

14. An exercise machine comprising:

a frame for positioning on a surface;

a bench secured to the frame for supporting a user;

a first arm rotatably attached at one end to the frame for movement at another end by a user between a first position and a second position;

a second arm rotatably connected at a first end to the first arm proximate the other end thereof, a second end of the second arm being moveable by a user between a retracted position proximate the first arm and an extended position away from the first arm;

a resistance member operationally engaging the frame and the second arm to resist movement of the first arm and to resist movement of the second arm;

a first guide connected to the second arm;

a second guide connected to the frame and spaced away from the first guide;

a cable trained around the first and second guides;

an anchor attaching one end of the cable to the first arm for movement therewith; and a resistance mechanism operable to resist motion of the cable.

15. An exercise machine comprising:

a frame for positioning on a surface;

a bench secured to the frame for supporting a user;

a first arm rotatably attached at one end to the frame for movement at another end by a user between a first position and a second position;

a second arm rotatably connected at a first end to the first arm proximate the other end thereof, a second end of the second arm being moveable by a user between a retracted position proximate the first arm and an extended position away from the first arm;

a resistance member operationally engaging the frame and the second arm to resist movement of the first arm and to resist movement of the second arm;

a first guide connected to the second arm;

a second guide connected to the frame and spaced away from the first guide;

a cable trained around the first and second guides;

a resistance mechanism operable to resist motion of the cable; and a foot member movably attached to the other end of the first arm and positionable between a first position toward the bench and a second position away from the bench.

16. The exercise machine of claim 15, wherein the foot member includes a foot plate connected to an extension having a plurality of apertures therealong to be adjustable by a removable pin through one aperture of the plurality of apertures.

17. The exercise machine of claim 15, wherein the foot member is rotatable between the first position and the second position.

18. An exercise machine comprising:

a frame for supporting an exercise machine on a surface;

a bench secured to the frame for supporting a user;

a first arm rotatably attached at one end to the frame for movement at another end by a user between a first position and a second position;

a second arm rotatably connected at a first end to the first arm proximate the other end thereof, a second end of the second arm being movable by a user between a retracted position proximate the first arm and an extended position away from the first arm;

means associated with said first arm proximate said other end for contact by a user on said bench for urging said first arm from said first position to said second position;

means associated with said second arm for contact by a user on said bench for urging said second arm from said retracted position to said extended position; and a resistance member operationally engaging the frame and the second arm to resist movement of the first arm and to resist movement of the second arm.

19. An exercising machine comprising:

a frame for supporting an exercise machine on a surface;

a bench secured to the frame for supporting a user;

a first arm rotatably attached at one end to the frame for movement at another end by a user between a first position and a second position;

a second arm rotatably connected at a first end to the first arm proximate the other end thereof, a second end of the second arm being movable by a user between a retracted position proximate the first arm and an extended position away from the first arm;

a resistance member operationally engaging the frame and the second arm to resist movement of the first arm and to resist movement of the second arm, said resistance member including a first guide connected to the second arm;

a second guide connected to the frame and spaced away from the first guide;

a cable trained around the first and second guides;

a resistance mechanism operable to resist motion of the cable; and an anchor attaching one end of the cable to the first arm for movement therewith.

* * * * *